United States Patent [19]

Grenier

[11] 4,184,569

[45] Jan. 22, 1980

[54] LADDER STANDOFF AND RIDGE POLE HOOK

[76] Inventor: Joseph N. O. Grenier, 358-360 Queensway South, Keswick, Ontario, Canada, L4P 2C2

[21] Appl. No.: 848,580

[22] Filed: Nov. 4, 1977

[30] Foreign Application Priority Data

Jun. 15, 1977 [CA] Canada ..... 427241

[51] Int. Cl.[2] ..... E06C 7/48; E06C 1/36

[52] U.S. Cl. ..... 182/206; 182/214

[58] Field of Search ..... 182/214, 229, 107, 108, 182/206, 109, 110; 248/210, 211

[56] References Cited

U.S. PATENT DOCUMENTS

| | | | |
|---|---|---|---|
| 2,256,452 | 9/1941 | Marshall | 182/214 |
| 2,896,831 | 7/1959 | Ellingson | 182/206 |
| 2,903,086 | 9/1959 | Chubbs | 182/214 |
| 3,779,344 | 12/1973 | Rister | 182/214 |

*Primary Examiner*—Reinaldo P. Machado
*Attorney, Agent, or Firm*—Zalkind & Shuster

[57] ABSTRACT

A simple device comprising members such as a pair of identical tubes or bars fastenable anywhere along the rails or stiles of a ladder by U-bolts passing through diametric bores is provided. The U-bolts constitute a clamping means whereby standoff members can be made secure to respective sides of a ladder, such members extending forwardly to engage the wall or roof of a building or to hook over the apex of a sloped roof or ridge pole of a building where the ladder is used by a workman on the roof to facilitate his movement on a sloping roof. The ends of the tubular members are provided with abrasion protecting caps so that the ends of the tubes will not scuff or mar a surface against which they are raised.

8 Claims, 8 Drawing Figures

LADDER STANDOFF AND RIDGE POLE HOOK

BACKGROUND OF THE INVENTION

Ladder standoffs have heretofore been known, for example, as shown in various prior art patents, such as the following:

| | | |
|---|---|---|
| Taylor | 1,393,922 | Oct. 18, 1921 |
| Heun | 1,508,392 | Sept. 4, 1923 |
| Seaman | 1,541,402 | July 31, 1922 |
| Couche et al | 1,543,551 | Nov. 10, 1924 |
| Coddington | 2,199,042 | Sept. 27, 1939 |
| Jarboe | 3,853,202 | Dec. 10, 1974 |
| British patent | 436,679 | Oct. 16, 1935 |

All of the above patents have various drawbacks, such as complexity, lack of versatility, destructive of house walls, and destructive of ladder rails to which they may be attached, among others.

Further, the structures of such prior art devices are of a complex and frequently expensive nature, and pose mechanical problems overcome by the present invention. The invention can be readily mass produced and sold at a price such that the average homeowner who may have only occasional use for a ladder standoff or ridge pole hook need make only a small investment for the device of the invention. In addition, the sturdiness of the invention coupled with price economy makes it feasible for the professional house repairman or roof repairman to own a number of such devices and save time by having ladders equipped with same without the need to remove them and replace them each time a particular ladder is to be used.

DESCRIPTION OF THE INVENTION

A detailed description of the invention now follows in conjunction with the appended drawing, in which FIG. 1 illustrates a horizontal section through a ladder showing the rail elements to which the invention is attached as a pair of elongated members extending from the plane of the ladder;

Figure 1:
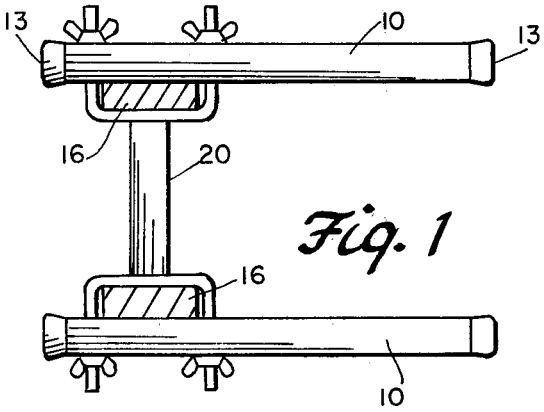
Figure 3:
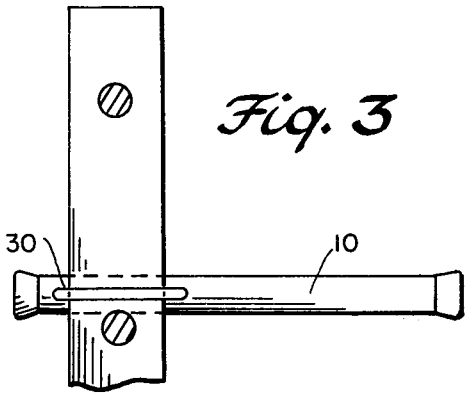
FIG. 3 is similar to FIG. 2 but illustrating the interior of the ladder with one of the members of the invention attached.
Figure 5:
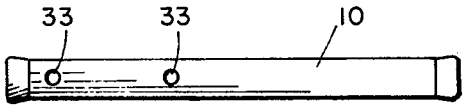
FIG. 5 shows an elevation of one of the members illustrating the locations of the apertures therein.
Figure 2:
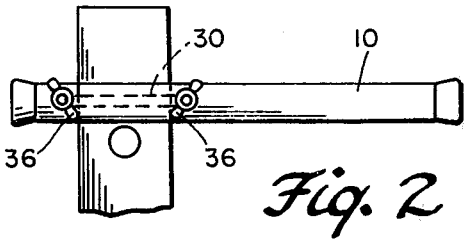
FIG. 2 illustrates an elevation of the exterior of the ladder, wherein one of the members has been secured thereto.
Figure 4:
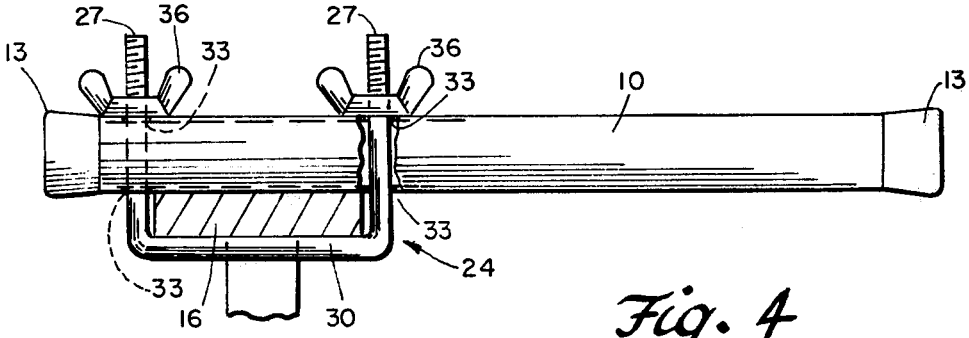
FIG. 4 is a detailed plan view of one of the members of the invention showing structural details.

Referring now to FIGS. 1–5 the invention comprises a pair of preferably identical tubular members 10 provided at both ends with abrasion preventing force fitted plastic or rubber caps 13 and secured to the respective rails 16 of a ladder by a clamping means comprising a U-bolt 24 having a pair of parallel legs 27 extending normally to a midsection 30 and each leg passing through diametrically opposed apertures 33 in the respective tubular member 10. The apertures have the spacing of legs 27 so that the U-bolt can pass therethrough.

The bridging member 30 of each U-bolt is clamped securely against a ladder rail 16 by means of wing nuts 36 threadedly disposed on respective legs 27 as shown. Thus, each of the tubular standoff members is disposed on the exterior of the respective ladder rails and firmly fastened thereto, preferably with the bridging member 30 engaging the top or bottom of a rung so that the elongted standoff members are in the same plane and extend normally to the plane of the ladder.

It has been found that for general utility a hollow, tubular member of aluminum or steel one-inch in outer diameter and approximately one foot long is suitable for applicant's purposes, although longer tubular members may be used to suit various special circumstances and several apertures such as 33 may be provided to selectively adjust the standoff distance as desired. For general use it has been found suitable to have the tubular member extending outwardly from the rail of the ladder for a distance of seven to eight inches as a standoff or hook while the other, or outer, end of the member may, of course, be considerably foreshortened.

It is preferable to provide the outer ends with a plastic or rubber cap such as 13 to prevent injury on what might otherwise be the sharp edge on an aluminum or steel tube.

Likewise, it has been found that the inside distance between legs 27 of approximately three inches is suitable for most purposes and a large variety of ladder rails will fit therebetween. Here again it will be obvious that the bridging member 30 may be made longer or shorter to fit a large number of ladders having sides of narrower or wider dimensions than general purpose house ladders.

In any event, the simple clamping means comprising a U-bolt having integral legs and bridging member has been found to provide ample margin of safety for securing the standoff members to the ladder rails.

Figure 6:
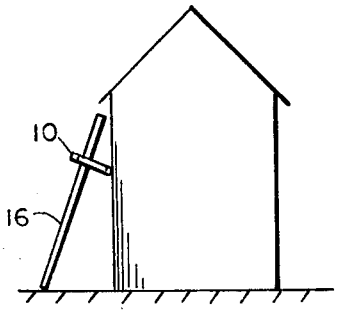
FIG. 6 illustrates schematically the invention used as a standoff against the wall of a house.

FIG. 6 illustrates the mode in which a ladder equipped with the invention stands off from the wall of a building so that a workman can point or do repairs, etc. It should also be noted that a work tray, tool or paint apparatus could be set on the standoff members, although in such case it might be preferable to have the ladder in more vertical position so as to minimize the bar slant. It should also be noted that the standoff members are at a greater distance from the ladder top than in FIGS. 7 and 8 for choice of location of work tray, etc.

Figure 7:
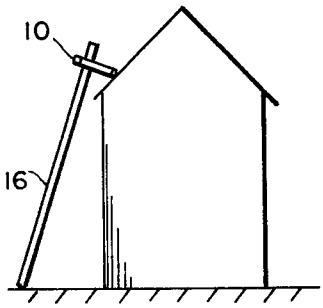
FIG. 7 illustrates the invention being used as a standoff against the sloping roof of a house.

FIG. 7 is essentially the same as FIG. 6 but illustrating the invention wherein the standoff members are raised against a sloping roof in order to provide ready access thereto.

Figure 8:
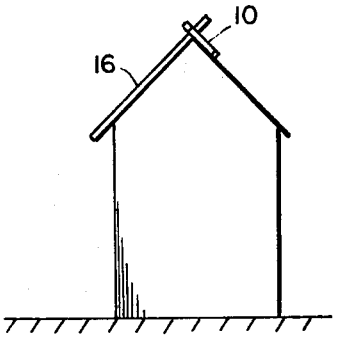
FIG. 8 illustrates the invention used as a ridge pole hook over the apex of a sloping roof.

FIG. 8 illustrates the invention applied to a ladder laid across a sloping roof so that a workman painting or repairing the roof may readily move up and down on the ladder in perfect safety inasmuch as the standoff members securely hook over the apex or ridge pole.

From the preceding description it will be apparent that my invention is not only capable of economical mass production and relatively low selling price but is virtually foolproof in being installed on a ladder anywhere along the length thereof, although, of course, as a matter of safety the bar members should be somewhere at the upper portion. Further, it will be apparent that the invention comprising a pair of identical members is relatively compact for storage and by virtue of the anti-abrasion caps will not scuff or mar walls or roofs against which the standoff may effect engagement. Other advantages will be apparent to persons having practical knowledge of the field and the invention herein is not to be taken as limited to the structure shown except to the extent set forth in the appended claims.

For example, other uses of the invention would be where it is necessary to lean a ladder against a low shed, in which case the fact that the standoff members can be attached to the ladder rails anywhere along the length of the ladder so as to provide a convenient angle of the ladder will be apparent. Also it will be apparent that the ladder can be leaned against the corner of a building with a standoff member on each of the intersecting walls. Yet further, the invention can be used by applying a pair of standoff members to each of a pair of ladders but oriented on each such ladder in opposite directions. When such ladders are leaned against the wall of a building spaced a few feet apart, the outwardly extending standoff members can support a plank on which a workman can walk as on a scaffold. It will, of course, be understood that the pairs of supporting members extending from each side of the ladders will be at the same height from ground on the respective ladder sides in order to insure a level walking surface.

What is claimed is:

1. A ladder standoff and ridge pole hook comprising in combination a pair of bars of predetermined length, said bars having spaced bores transversely therethrough; a clamp for each bar having a bridging means to straddle a respective rail of a ladder at one side of the rail and each bridging means having fastening means to pass through the spaced bores of a respective bar disposed on the opposite side of said rail to clamp said bar thereto, whereby a bar may be clamped to each rail of a ladder and extending outwardly of the plane thereof for engaging a support surface or to hook over a roof ridgepole.

2. A device as set forth in claim 1, wherein said bars comprise cylindrical tubes and said spaced bores are provided diametrically therethrough; and each of said bars having an abrasion preventing cap to prevent at the engaging end damage to a support surface.

3. A device as set forth in claim 1, wherein each said clamp comprises a U-bolt having a bridging member and integral legs extending therefrom protruding through respective of said spaced bores; and extremities of said legs threaded and securing nuts thereon.

4. A device as set forth in claim 1, wherein said bars comprise cylindrical tubes and said spaced bores are provided diametrically therethrough, each said clamp comprising a U-bolt having a straight bridging member and integral legs extending therefrom, the extremities of said legs being threaded and with securing nuts thereon.

5. A device as set forth in claim 1, including abrasion preventing caps at the extremities of said bars for non-abrasive engagement with a wall or roof and additional abrasion preventing caps on the opposite ends of respective bars to prevent personal injury.

6. A device as set forth in claim 1, wherein said bars comprise cylindrical tubes and said spaced bores are provided diametrically therethrough, including abrasion preventing caps at the extremities of said bars for engagement with a wall or roof and at opposite extremities to prevent injury.

7. A device as set forth in claim 1, wherein each said clamp comprises a U-bolt having a straight bridging member and integral legs extending therefrom through respective spaced bores, the extremities of said legs being threaded and securing nuts thereon, including abrasion preventing caps at the extremities of said bars for engagement with a wall or roof.

8. A device as set forth in claim 1, wherein said bars comprise cylindrical tubes and said spaced bores are provided diametrically therethrough; said clamp comprising a U-bolt having a straight bridging member and integral legs extending through each said spaced bores, the extremities of said legs being threaded and securing nuts thereon, including abrasion preventing caps at the extremities of said bars for engagement with a wall or roof.

* * * * *